US006121946A

United States Patent [19]

Shen

[11] Patent Number: 6,121,946

[45] Date of Patent: Sep. 19, 2000

[54] WAVEFORM SCAN SYSTEM

[76] Inventor: Xing Liang Shen, 2764 Harway Ave. 1 Fl., Brooklyn, N.Y. 11214-5540

[21] Appl. No.: 08/734,741

[22] Filed: Oct. 21, 1996

[51] Int. Cl.[7] ..... G09G 3/00

[52] U.S. Cl. ..... 345/94; 345/4; 345/5; 345/30; 345/208

[58] Field of Search ..... 345/4, 5, 6, 139, 345/30, 55, 87, 94, 208

[56] References Cited

U.S. PATENT DOCUMENTS

| | | | |
|---|---|---|---|
| 3,665,282 | 5/1972 | Skehan | 318/627 |
| 3,975,085 | 8/1976 | Yamada et al. | 349/33 |
| 4,464,656 | 8/1984 | Nakamura | 345/134 |
| 5,519,414 | 5/1996 | Gold et al. | 345/208 |
| 5,530,373 | 6/1996 | Gibson et al. | 324/758 |

*Primary Examiner*—Bipin H. Shalwala
*Assistant Examiner*—Vincent E. Kovalick

[57] ABSTRACT

A waveform scan system produces two pairs of special waves with special waveforms that are led to front and rear layers of an electrically-conducting media which contains three overlaid layers. In there they form special stationary waveforms which contains a vertical and a horizontal maximum peak lines. These two peak line cross in space and their perpendicular line present a maximum peak point. Under a control unit, this maximum peak point will scan whole screen media and synchronize with incoming signals. The middle layer connect to the signals processor that allows signals to be converted or be reproduced therein. Thereby the time domain serial signals can be reproduced in different locations in the space domain. Vice versa, the space domain signals can be convert or record in a time domain media.

8 Claims, 5 Drawing Sheets

WAVEFORM SCAN SYSTEM

BACKGROUND OF THE INVENTION

The present invention relates to scan systems that scan two dimensional space for providing different spaces between space domain signals and time domain signals. More particularly, the present invention uses an untraditional way that uses space domain waveforms and statics to accomplish the scanning function.

Up until now, scan systems that are widely used for scanning an image use the time domain waveform to scan different spaces for representing time domain series signals in a medium, such as a CRT. It uses magnetic or electric deflecting systems to deflect the beam of electrons in an evacuated tube, with the electron beam then scanning the screen. They are usually huge and heavy. These problems will be more serious in large screen sizes.

Another example of scan systems use flat display devices. They use many vertical and horizontal lines to accomplish the scan function. This method limits high resolution display, is hard to make a big size flat screen, and greatly increases manufacturing cost.

SUMMARY OF THE INVENTION

Accordingly, several advantages of using a waveform scan system include, inter alia:

A control unit makes it easy to develop any functions of scanning two dimensional screens, such as "fast scanning," "normal scanning," and "slow scanning," etc., in TV and Camcorder machines.

Two pairs of oscillators generate special waves. The waveform of the special waves have two portions in one period, namely, one is the pulse portion that only contains one positive or one negative pulse that is the same in width, and the other portion is a long intermittence which is changed by the control unit. One pair of special waves only contain positive pulses, while the other pair will only contain negative pulses.

Two pairs of narrow circuits narrow the pulses of the special waves to gel a certain image density.

A two-dimensional electrically conducting medium contains three layers that form a two dimensional screen. These three layers lay one in front of the other. The front layer is made of a conductive and crystal material, and is used to form a two dimensional stationary waveform that contains a vertical or horizontal maximum peak line. The middle layer is made of a material that is stimulated to emit light under certain strength electronic power. The rear layer is made of a conductive material, and is also used to form a two dimensional stationary waveform that contains a horizontal or vertical maximum peak line.

Two pairs of triangle connectors are connected with the narrow circuits and screen medium. One pair of triangular connectors are inserted between the narrow circuits and the front layer of the screen medium, while the other pair of triangular connectors are inserted between the narrow circuits and the rear layer of the screen medium.

Two pairs of special waves pass through their own narrow circuits. The narrowed special waves input to the front and rear layers of the screen medium. For example, two sides of the front layer, or upper and lower sides of the rear layer. They spread in opposite directions in these layers and form a stationary waveform that contains a vertical and a horizontal maximum peak line. These two maximum vertical and horizontal peak lines cross in space. Their perpendicular line represents the maximum peak voltage. If we design the middle layer to emit light only under this maximum peak voltage value, a point of light will be presented on the screen medium.

The control unit controls the intermittence of the waves. For example, the length of the right entry wave intermittence is a little longer than that of the left, while the vertical maximum peak line moves from left to right constantly. The horizontal maximum peak line works on the same principle as the vertical one, but moves from top to bottom. If we design the speed of the vertical maximum peak line and the speed of the horizontal maximum peak line to be the same as a TV deflection system, the point of light scans the whole screen medium. The control unit controls each special wave initial phase to synchronize the video signals.

The novel features which are considered characteristic of the present: invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWINGS

The figures of the drawing are briefly described as following.

DETAIL DESCRIPTION OF THE PREFERRED EMBODIMENTS

Figure 1:
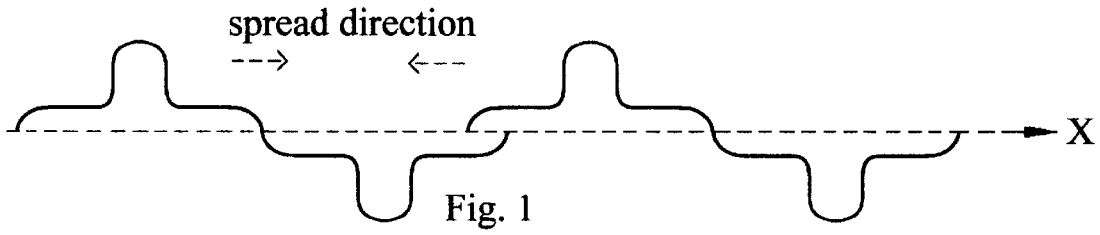
FIG. 1 is a diagrammatic representation of an example of a special waveform that can form the stationary waveform and which contains a maximum peak point.
Figure 2:
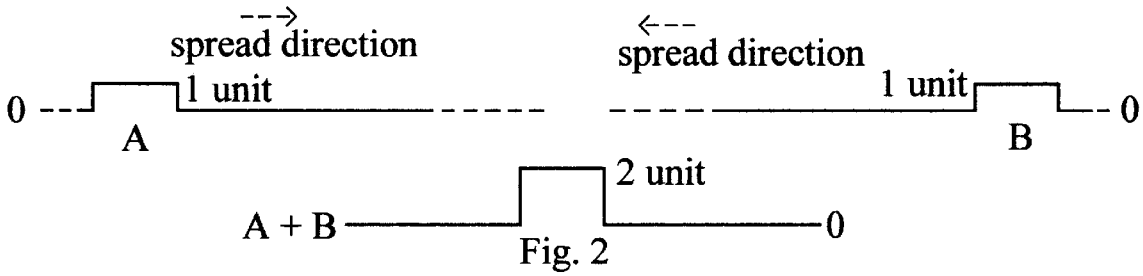
FIG. 2 is diagrammatic representation of another example of the special waveform that can also form the stationary waveform and which also contains a maximum peak point and which is used in the present invention.

For easy explanation, we discuss one dimensional space. Then enlarge the cross direction into two dimensional space. As we know, sine or cosine waves can form a stationary waveform under a certain condition. If we define a wide meaning stationary waveform, these stationary waveforms will have a peak value that always appears at a fixed position. There can also be other special waves. Examples of these special waveforms are shown in FIGS. 1 and 2, which are, respectively, a diagrammatic representation of an example of a special waveform that can form the stationary waveform and which contains a maximum peak point, and a diagrammatic representation of another example of the special waveform that can also form the stationary waveform and which also contains a maximum peak point and which is used in the present invention. If we take a medium length equal to one period of the special waveform length, the stationary waveform will only have one maximum peak value. Changing the initial phase of the special wave, the maximum peak point will form at different locations of the medium.

Using this characteristic, we can make a waveform scan system.

Figure 3:
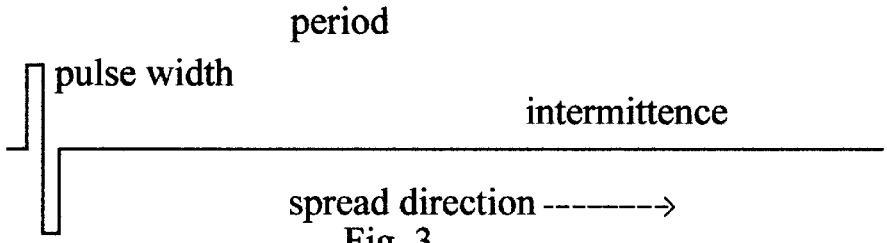
FIG. 3 is a diagrammatic representation of the left side entry waveform used in the present invention.

As shown in FIG. 3, which is a diagrammatic representation of the left side entry waveform used in the present invention, the left entry waveform generated by a fixed frequency oscillator contains two portions, namely, a positive pulse whose widths are kept the same to maintain the same image density, and the intermittence.

The length of the waveform determines the maximum medium width. If the medium width is wider than the waveform length, there will more than one peak point appearing in the medium. This situation is not good for representing or handling a time serial signal.

Figure 4:
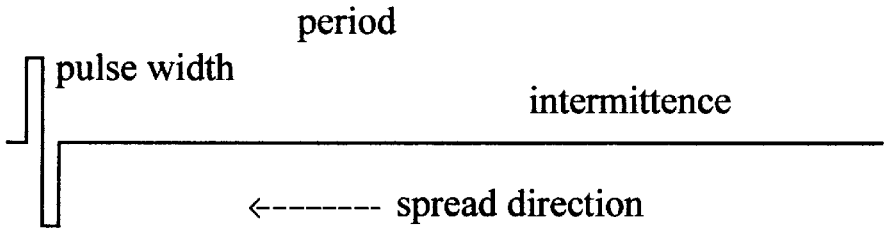
FIG. 4 is a diagrammatic representation of the right side entry waveform used in the present invention.

As shown in FIG. 4, which is a diagrammatic representation of the right side entry waveform used in the present invention, the positive width pulse portion is the same as the left one, but the intermittence length is a little longer than the left one. The difference in intermittence between the left and the right waves determines the speed of the maximum peak point movement and the direction of that movement. The greater the difference in the intermittence, the faster the maximum peak point moves. For example, if we design the right wave intermittence to be a little longer than that of the left, after each period, the right pulse is always delayed a little time before it meets the left one, while the left and right special waveform sources continuously send the special waveforms, the maximum peak point always forms a little to the right of it's prior, or in other words, the maximum peak point moves from the left side to the right.

The initial phases of the special waves determine the start position of the maximum peak point movement. At the initial value shown in FIGS. 3 and 4, which again are a diagrammatic representation of the left side entry waveform used in the present invention, and a diagrammatic representation of the right side entry waveform used in the present invention, respectively, the maximum peak point will start at the left end side. After the maximum peak point moves to the end of the right of the medium, and if the oscillators continually generate the special waves, then the maximum peak point will appear on the left end side again and move to the right.

Figure 5:
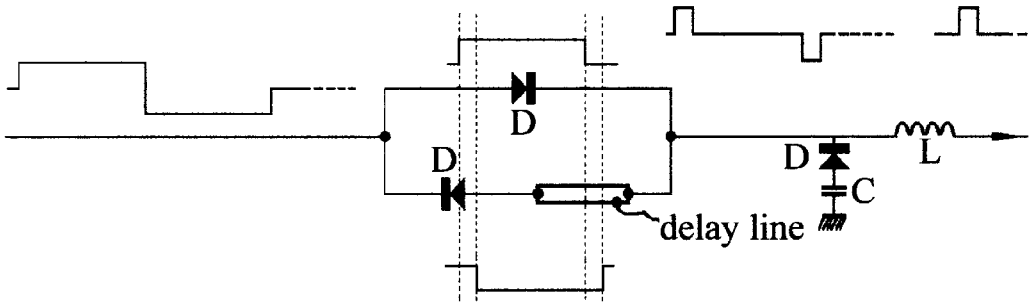
FIG. 5 is a schematic diagram of the narrow circuit utilized in the present invention and the waveform generated thereby.

The width of the maximum peak area determines the image density. If we use a half sine waveform as a pulse, and if a ECG77 transistor is used, the pulse width will be about 83.4 mm. For normal image using, this pulse is too big. If a 1 mm pulse width is requested, the elements have to work at 150,000 MHz. Such high frequency circuits are very hard to design. Therefore, we need a narrow circuit as shown in FIG. 5, which is a schematic diagram of the narrow circuit utilized in the present invention and the waveform generated thereby.

A complete wave from the oscillator is split into two, by two diodes, whose polarities are connected reversely. The positive wave passes into the up branch, through a diode, and to the output. The negative wave passes into the down branch, through another diode and a delay line, and to the output. The delay line is designed to delay the negative pulse a little less than half the pulse time. When these two waves come together, most portions thereof cancel each other out, and only narrowed positive and negative pulses are delivered to the output. Another diode with some auxiliary elements select what polarity pulse to pass through.

If we enlarge one dimensional space in its cross direction into two dimensional space, the maximum peak presents a line. Therefore, a triangle connector is inserted between the narrow circuit and the medium to achieve this purpose.

Figure 6:
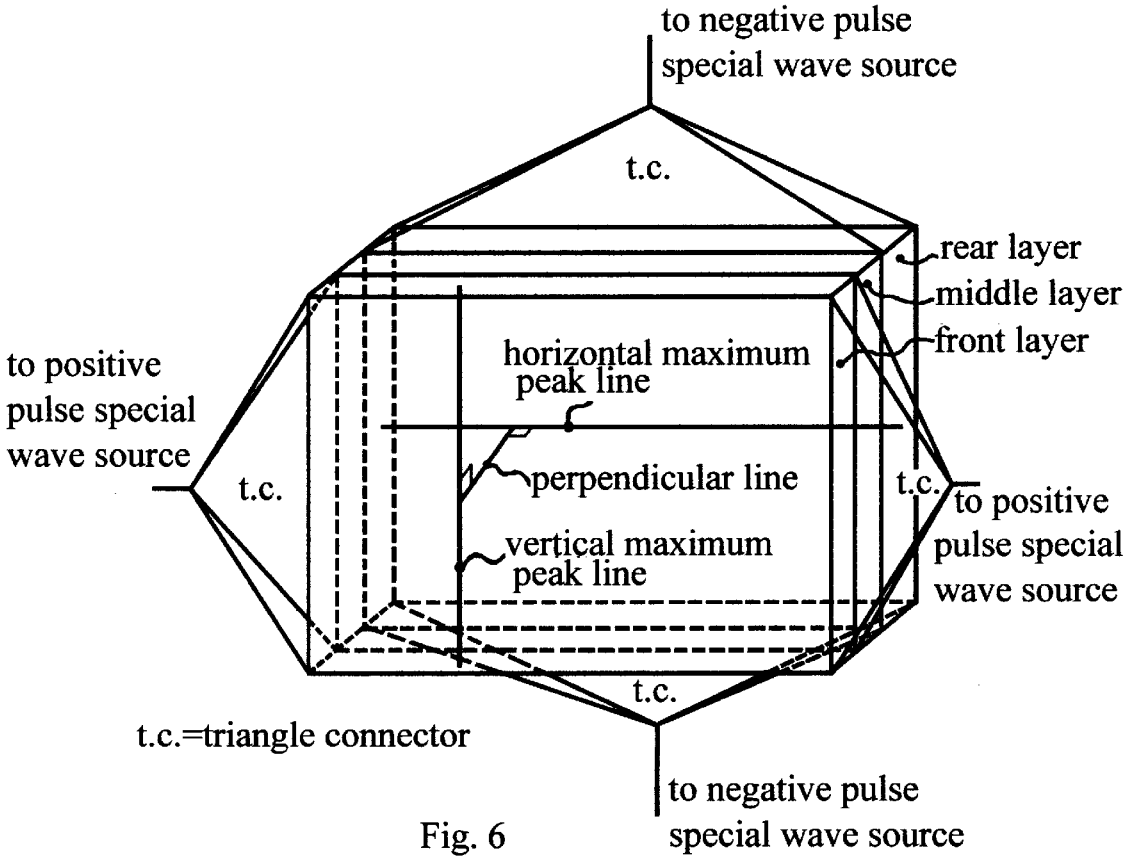
FIG. 6 is a block diagram of the two dimensional screen medium with the other components of the present invention.

Referring to FIG. 6, a screen medium contains three layers that lay one in front of the other. The front layer is made of conductive and crystal material. The middle layer is made of a material stimulated to emit light under certain strength electric power, or stimulated to generate a electric parameter by incoming light. The rear layer is made of a conductive material. The front and rear layers are connected to the special wave source by using the triangle connectors. The middle layer is connected to a signal processor. Considering that the signal changing speed is much smaller than that of the electric field speed, we can say at certain times, that the signal in a small area is equal everywhere. Therefore, we can connect the signal to the middle layer anywhere. Whole screen medium works as a phototransistor.

As mentioned, supra, the length of a single period special waveform determines the maximum screen width. The special wave functions as the carrier. If we need to handle a video signal, the carrier frequency must be very high. The result is that the screen width may be too small. How does one eliminate this limitation?

Figure 7:
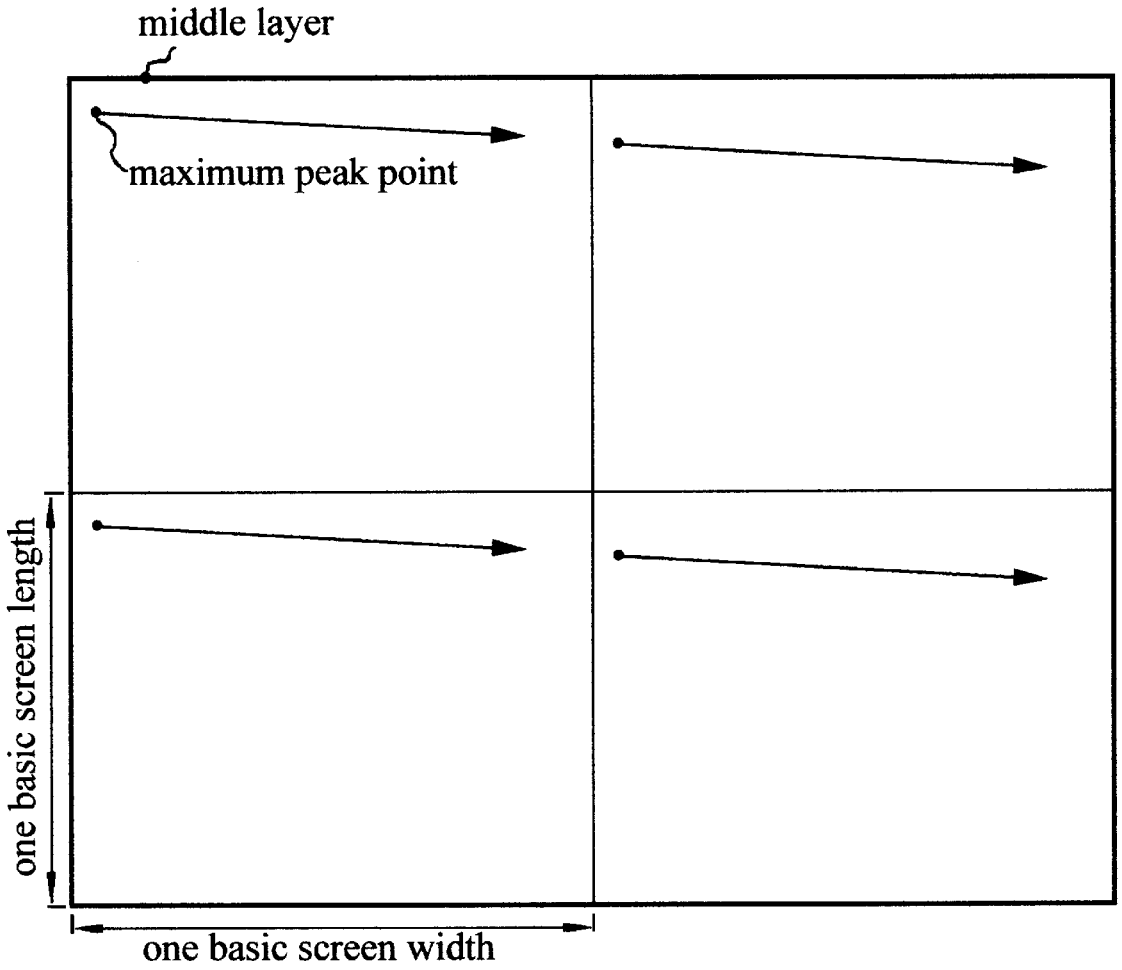
FIG. 7 is a block diagram illustrating the screen medium of the middle layers connected in series to extend the screen dimensions.

The solution is using a series connection. Many screen medium are connected in series. The front layer and the rear layer may be connected continually. The middle layers must be separated from each other at one screen medium size. The signal must serially connect and disconnect to each middle layer of the screen media block. For example, we connect four screen medium to compose a big screen. The diagram is shown in FIG. 7, which is a block diagram illustrating the screen medium connected in series to extend the screen width. The figure only shows the middle layers. Anytime there is one maximum peak point in every screen medium block and they move synchronously, only one middle block layer is connected to the signal source. When we connect and disconnect the middle block layers in certain sequence, the big screen will show a complete image. Therefore, the screen width may extend to any desired dimension.

Figure 8:
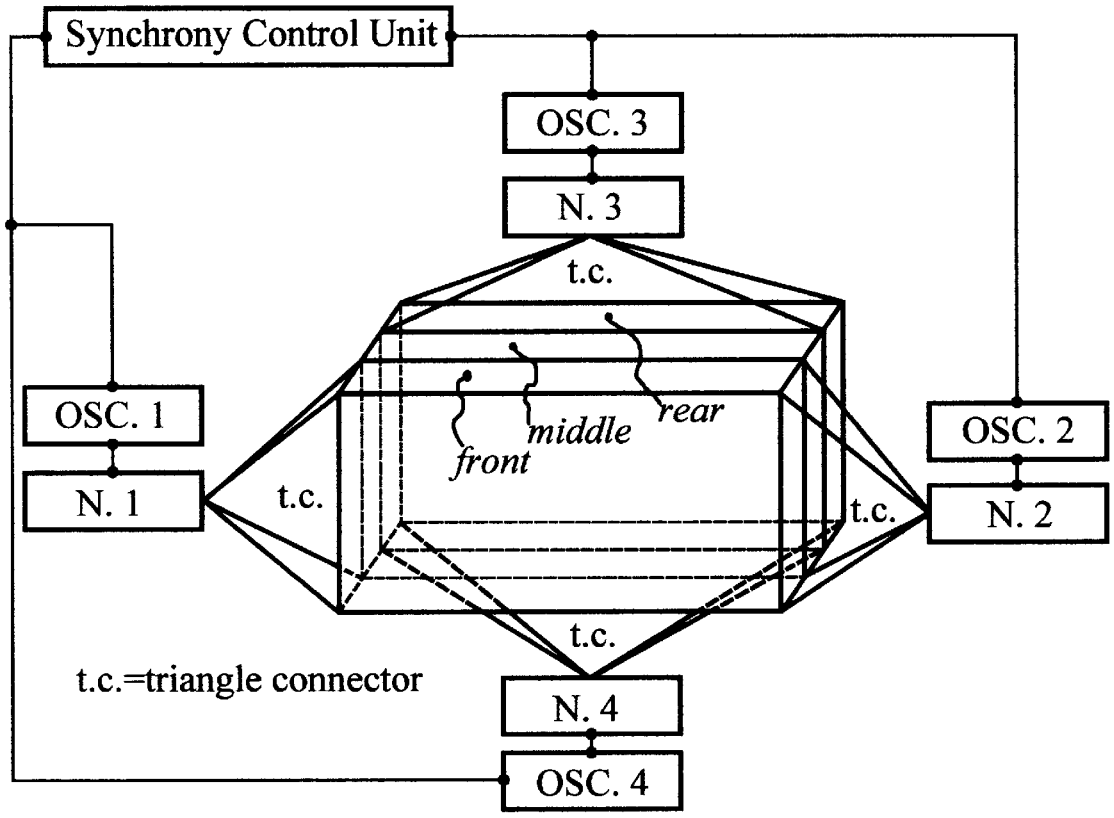
FIG. 8 is a block diagram using the scan system in a flat display device.

The scan system using a flat display device is shown in FIG. 8, which is a block diagram of the flat display.

Two pairs of special wave generators OSC. 1, OCS. 2, and OCS 3, OCS 4 compose the vertical and horizontal scan systems. Each pair of generators only create one maximum peak line in the front and rear layers of the screen medium. For example, if the vertical system uses a positive pulse of the special waves, then the horizontal system uses a negative pulse of the special waves. One pair of special waves lead to two sides of the front layer of the screen medium, in which they form a vertical maximum peak line. The other pair of special waves lead to the top and bottom of the rear layer of the screen medium in which they form a horizontal peak line. These two maximum peak lines will cross in space. Their perpendicular line will represent a maximum peak voltage value. If we design for use only under this maximum peak value, the middle layer will be stimulated to emit light, or vice versa, the middle layer will be stimulated to generate an electric parameter by some incoming power, such as lights. So this perpendicular peak value works as a trigger. While the vertical maximum peak line moves from left to right, and the horizontal maximum peak line moves from top to bottom, the trigger point will scan the whole screen.

The control unit controls the initial phase of every special wave to achieve synchronism with the TV signal or other purposes.

Figure 9A:
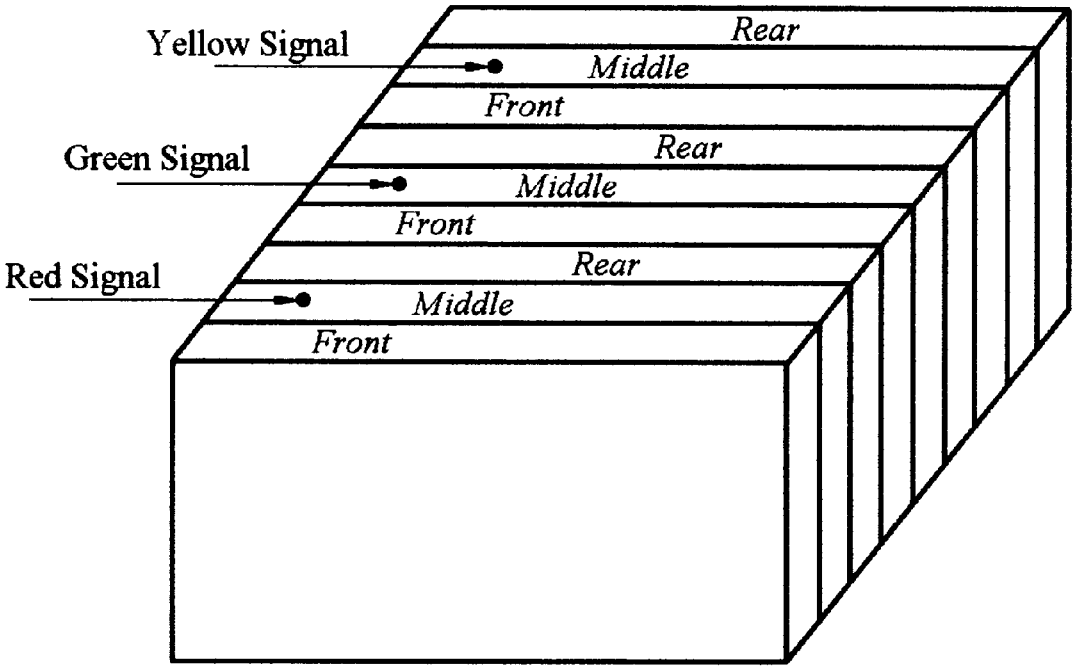
FIGS. 9A,9B are diagrammatic perspective views of the scan system in the color flat display medium of FIG. 8.
Figure 9B:
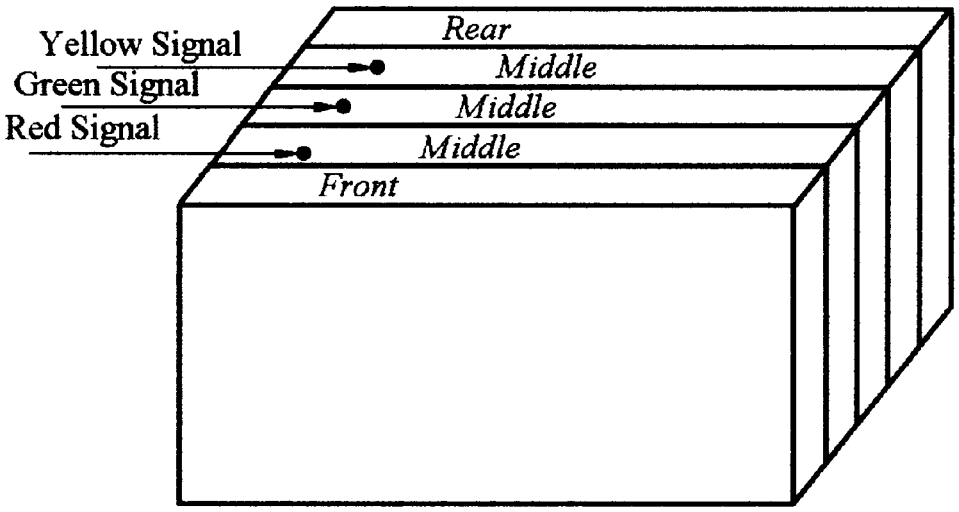

See FIGS. 9A and 9B, which are the diagrammatic perspective view of the scan system using the color flat display medium of FIG. 8.

It will be understood that each of the elements described above, or two or more together, may also find a useful application in other types of constructions differing from the types described above.

While the invention has been illustrated and described as embodied in a non-physical movement component recording reproducing device and flat display device, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A waveform scan system, comprising:

a) means for producing two pairs of special waves and its special waveforms contain the pulse portion and the long length intermittence portion, said two pairs of special waves used to form two special stationary waveform in which contains a maximum peak area;

b) a two dimensional electrically-conducting media in which contains three layers that overlay one on front of each others, the front layer of said three layers of material in which said special stationary waveform can be formed, the middle layer of said three layers of material reactive with electric power or reactive with incoming power in which the image signals can be display or be handled for further process and reactively means it characters will be changed under certain strength electrically-power or incoming power, the rear layer of said three layers of material in which said special stationary waveform can be formed;

c) a control unit by which to change said intermittence length of said special waves, or to change the phase of said special waves, or to change both said intermittence length and said phase of said special waves whereby the movement of said maximum peak lines can be controlled whereby said scan system achieves synchronism with outside signal, or achieve to other purpose;

d) said one pair of special waves are led to two sides of said front layer of said media and spread in it at opposite directions to form said special stationary waveform that contains a maximum vertical peak line area, said anther pair of special waves are led to top and bottom sides of said rear layer of said media and spread in it at opposite directions to form said special stationary waveform that contains a horizontal maximum peak line area, said vertical and horizontal maximum peak lines cross in space and their perpendicular line presents a maximum peak point value, while said vertical maximum peak line said horizontal maximum peak line move by said control unit, said maximum peak point scans whole said two dimensional electrically-conducting media whereby the said peak point works as trigger.

2. The device as defined in claim 1, wherein said one pair of said special waves pulse portion further includes a positive pulse, and other said pair of special wave further includes a negative pulse whereby the said maximum peak point value can be formed.

3. The device as defined in claim 1, further contains narrow circuit in which one diode has a polarity and is contained in an up branch; other diode has a polarity and is contained in a down branch with a delay line wherein said up branch is in electrical communication with said down branch; said polarity of said one said diode is connected reversely to said polarity of said other said diode to split said special wave into said up and down branches and to align the positive pulse and negative pulse in a little staggered position whereby when two branches combine, most portions will cancel each other, only narrowed positive and negative peaks will be delivered to output whereby the certain image density can be obtained.

4. The device as defined in claim 1, further including two pairs of triangle connectors are inserted between said narrow circuits and the edge of said front and rear layers of said two dimensional media whereby one dimensional said special stationary waveform enlarge in cross direction into two dimensional special stationary waveform in which contain said maximum peak lines.

5. The device as defined in claim 1, b), the width of said two dimensional media equal or lease than one period of said special stationary waveform that contains a vertical maximum peak line, the high of said two dimensional media equal or than one period of said special stationary waveform that contains a horizontal maximum peak line, whereby the time domain signal and said two dimensional media create one to one relationship and so called basic two dimensional media size.

6. The device as defined in claim 1, wherein said electrically-conducting two dimensional media can further be connected in series connections in which at least said middle layers of said two dimension media are separated from each other at one said basic two dimensional media size, and only one block of said basic two dimension media works for handling fragment of image signals whereby the defined structure allows to extend screen size to any request dimension.

7. The device as defined in claim 1, b), said front layer of said two dimensional media of material crystal whereby said middle layer of said two dimensional media can react through said front layer.

8. The device as defined in claim 1, wherein numbers of said two dimensional media may further overlap together for handling multiple colors display or other purpose.

* * * * *